US005638776A

United States Patent [19]

Raynor

[11] Patent Number: 5,638,776

[45] Date of Patent: Jun. 17, 1997

[54] INTERNAL COMBUSTION ENGINE

[76] Inventor: Gilbert E. Raynor, R.D #1, Box 258, Danby, Vt. 05739

[21] Appl. No.: 13,362

[22] Filed: Feb. 4, 1993

[51] Int. Cl.[6] ..... F02B 53/00

[52] U.S. Cl. ..... 123/45 A; 60/605.1

[58] Field of Search ..... 123/45 A; 60/597, 60/605.1

[56] References Cited

U.S. PATENT DOCUMENTS

| | | | |
|---|---|---|---|
| 3,757,748 | 9/1973 | Arney | 123/45 A |
| 4,366,784 | 1/1983 | Paul | 123/45 A |
| 4,480,968 | 11/1984 | Duerr | 60/605.1 |
| 4,805,409 | 2/1989 | Kobayashi | 60/597 |
| 5,161,491 | 11/1992 | Graves | 123/45 A |
| 5,230,307 | 7/1993 | Tanigawa | 123/45 A |

*Primary Examiner*—Charles G. Freay
*Attorney, Agent, or Firm*—John J. Welch, Jr., Esq.

[57] ABSTRACT

An internal combustion engine employing two identical piston assembly units, each providing several piston faces of various diameters, oriented and reciprocating opposite to each other within housing which provides chambers to accommodate the several piston sizes. Heat lost through the walls and heads of combustion chambers in primary cylinders from combustion therein is absorbed by incoming combustion air pumped by compressor pistons into plenum chambers surrounding the primary cylinders, wherein elevated pressure is maintained to aid the heat transfer and to provide pressure for scavenging and recharging the primary cylinders. Combustion in the primary cylinders drives the piston assembly units inward, and combustion gases expand into the common secondary system to a pressure determined by the space provided, with plenum air then admitted to scavenge and recharge the primary cylinders, and equalize plenum, primary, and secondary chambers' pressure. The greater force derived from the greater areas of the secondary pistons drive the piston assembly units outward, which further compresses the air in the primary cylinders to diesel ignition temperature and replenishes the plenum air, as the combustion gases in the secondary chamber expand back close to ambient when the piston assembly units reach full outward travel and exhaust ports open. Longitudinal piston travel is converted to rotatory motion by conventional cylindrical cams, with followers, mounted in the housing, engaging sinusoidal cam grooves around the shanks of the piston assembly units, and splines couple the pistons' rotation to an output shaft passing through the axes of the pistons and housing.

1 Claim, 4 Drawing Sheets

INTERNAL COMBUSTION ENGINE

BACKGROUND OF THE INVENTION

This invention relates to internal combustion engines and, more particularly, to a thermally efficient engine.

1. Description of the Prior Art

Various types in great numbers of internal combustion engines have been designed, usually employing a crankshaft arrangement to drive an output shaft.

In the conventional crankshaft engine the heat which passes into the walls and head of the combustion chamber is wasted to atmosphere through a cooling system intended principally to protect the combustion chamber from overheating, and combustion gases are wasted out of the exhaust after initial expansion, even though they are still at high temperature and high pressure and contain approximately fifty percent of the energy released from the fuel.

2. Objects and Advantages of the Invention

The present invention has the following as examples of its objects and advantages:

High thermal efficiency will reduce the waste of fossil fuels.

Atmospheric pollution will be reduced as a result of burning less fuel per unit of work and a protracted burning time.

With the use of such alternate fuels as alcohol compressed natural gas, hydrogen, propane and methane, superior performance, endurance and cost effectiveness will be provided over that obtainable from conventional engines.

The present invention will produce comparable power at much lower weight and size than conventional engines.

The present invention will require fewer parts, thus simpler manufacture and lower consumption of metal reserves, and will not require a separate flywheel. The low pressure, low temperature exhaust of the present invention will require silencing and the exhaust piping of the present invention will not be exposed to the rapid deterioration resulting from the high temperature of the exhaust from the conventional engine.

The lighter weight of the present invention will reduce the energy which is expended for its own transport in mobile use.

SUMMARY OF THE INVENTION

The present invention relates to an internal combustion engine, which achieves high thermal efficiency and high mechanical efficiency by providing means for the air taken in to support combustion to capture the heat energy which passes into the walls and heads of the combustion chambers, confining this air so that the heat it absorbs will increase its pressure while retaining its density. The air is then cyclically directed into the combustion chambers, to scavenge the gases from the preceding combustion event, and to fill the combustion chambers with air to support the succeeding combustion event.

Thus, this energy, which is wasted through the cooling system of the conventional crankshaft engine is instead recovered to contribute to the work of scavenging, recharging and compressing the air which supports combustion.

The present invention provides means for the gases expanded after combustion in the primary combustion chambers to be further expanded against larger pistons whose greater area make fullest use of the gases' lowered pressure to perform additional work as they are expanded back more nearly to ambient.

Converting the longitudinal travel of the pistons into the more useful rotatory motion of the output shaft through the use of sinusoidal, cylindrical cam grooves, engaged by rotating followers mounted in the engine's housing, which provide a constant lever arm (represented by the cylindrical radius of the cam grooves) and efficient conversion of the longitudinal force developed by gas pressure on the pistons into torque in the output shaft, through 80% of the pistons' longitudinal travel. The arm of the crankshaft engine varies constantly, is at a minimum when combustion pressure is greatest, and reaches a maximum at ninety degrees of rotation, by which time the combustion pressure has been reduced by a factor equal to half the compression ratio. In addition, the two excursions of the sinusoidal grooves in this engine produce eight power strokes per output shaft revolution, for a power density approximately equal to that of a sixteen cylinder four-stroke cycle crankshaft engine.

DETAILED DESCRIPTIONS OF THE INVENTION

Figure 1A:
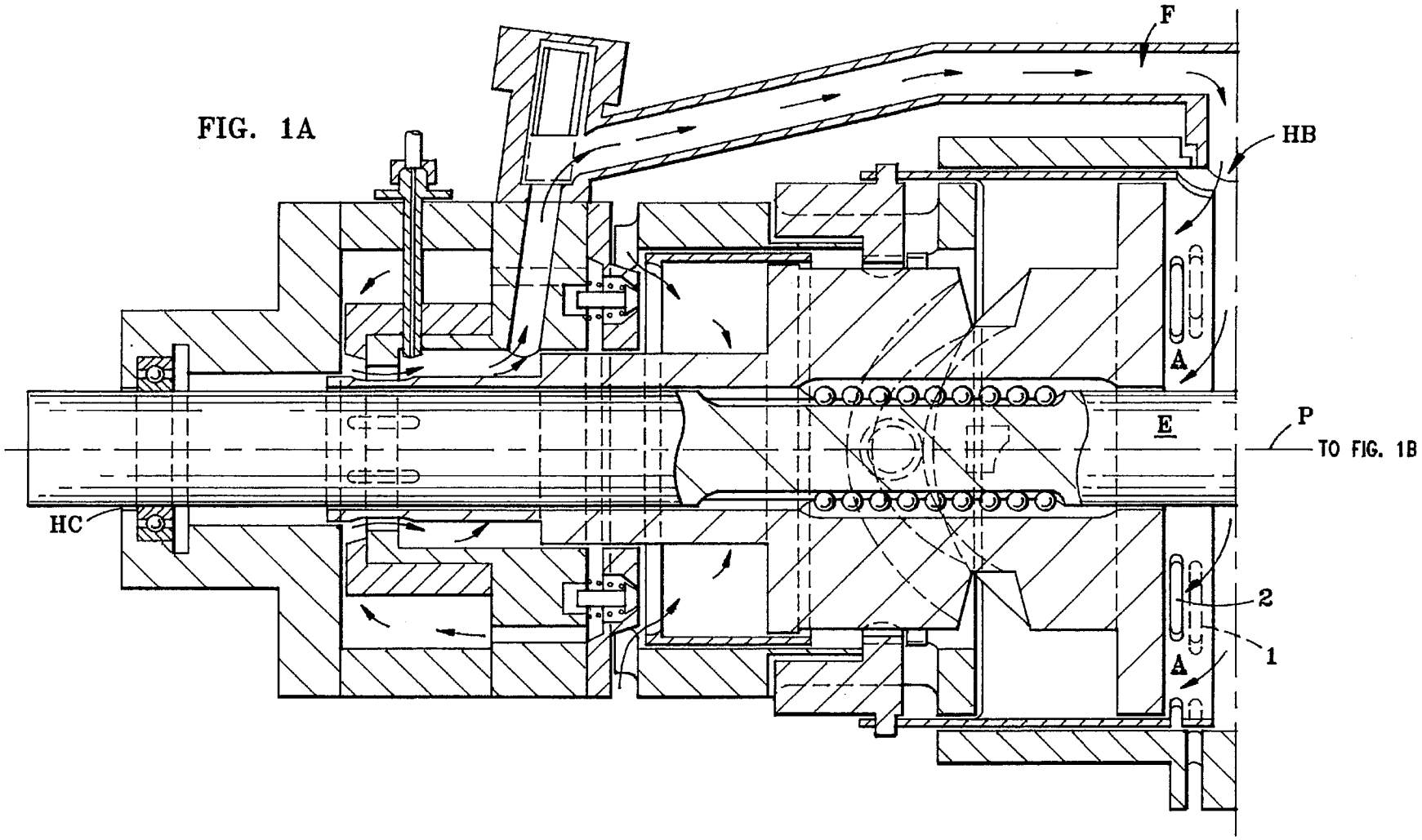
FIGS. 1A and 1B together are longitudinal schematic sectional views of an internal combustion engine according to the present invention.

With continuing reference to the drawings where like reference numerals designate similar parts in the two views, the following provides a description of the present invention.

A housing unit H made up of two identical joined tubular sections oriented opposite one another encloses two identical piston assembly units, each including a secondary piston 4, a rotator section 27, a compressor piston 13, a primary piston 21 and a sleeve extension 22. The piston assembly units are oriented opposite to each other, with the two secondary pistons 4 facing each other in a common secondary chamber A, the compressor pistons 13 operating each in their own compressor chambers B, the primary pistons 21 operating each in their own combustion chambers C, with the sleeve extensions 22 passing out through the combustion chambers C, and the head thereof, through the plenum chambers D, and out into suitable bores in the housing unit H. The piston assembly units are free to reciprocate and rotate within their respective chambers.

An output shaft E passes longitudinally through the axes of the piston assembly units and the housing unit H and is mounted in bearings 26 where it passes through holes HC in the respective outer ends of the housing unit H, extending outward beyond the housing unit H, where its ends may be connected to the power train of the machinery the engine is to power. The shaft E is free to rotate in the bearings 26. The long common horizontal tubular axis of symmetry HA of housing unit H and the long horizontal axis of symmetry P of the piston assembly units and output shaft are co-axial, one and the same.

The piston assembly units are coupled to the output shaft E by the bearing splines 9 which allow the piston assembly units to reciprocate along the output shaft E yet will force the shaft E to rotate as the piston assembly units are rotated as described below.

During operation, air to support combustion will be drawn into the compressor chambers B as the compressor sleeves 14 are drawn inward by the friction of the piston rings (not shown), which will seal between the compressor pistons 13 and the compressor sleeves 14, as the piston assembly units begin inward travel. This inward movement of the compressor sleeves 14 will unseat their tapered flanges 15 from the flange seat discs 16, allowing ambient air to flow through the air inlets 18 in the housing unit H and into the compressor chambers B as the continued inward travel of the compressor pistons 13 create a partial vacuum in the compressor chambers B.

When the piston assembly units next begin outward travel, the frictional engagement between the compressor pistons 13 and the compressor sleeves 14 will move the compressor sleeves 14 outward, seating their tapered flanges 15 against their respective flange seat discs 16 so that no air may escape therethrough. The continuing outward travel of the compressor pistons 13 will compress the air in the compressor chambers B until it reaches a pressure sufficient to overcome the pressure maintained in the plenum chambers D and force open the check valves 19 and pump new air through the air passages 20 into the plenum chambers D.

The combustion chambers C are surrounded by the plenum chambers D, so the heat from combustion which passes into the walls and heads of the combustion chambers C will, with the help of the fins 24, be conducted into the air in the plenum chambers D. Since this air is confined, the addition of heat increases its pressure, which will later contribute to the work of scavenging and recharging the combustion chambers C, with any surplus passing out into the secondary system (the transfer tubes F and the secondary chamber A) to add its energy to the second expansion. The high temperature and high pressure of the air charge in the combustion chambers C will enable auto ignition temperatures to be achieved at lower compression ratios than would be required with unheated air.

Concurrently, as the piston assembly units travel outward, air admitted into the combustion chambers C at the preceding full inward travel of the piston assembly units, and now confined therein, will be compressed until, at full outward travel, its temperature is increased sufficiently to initiate combustion of the fuel introduced through the injectors 30. The combustion of the fuel will increase the temperature, and thus the pressure, of the gases in the combustion chambers C and the pressure will act against the primary pistons 21 to force the piston assembly units inward.

Simultaneously, as the piston assembly units reach full outward travel, the exhaust open cams 5 engage the actuators 10, which are coupled to the exhaust sleeves 3 by the tangs 11, to move the exhaust sleeves 3 inward. This aligns the sleeve ports 2 with the housing ports 1 to permit the residual gases in the secondary chamber A, now reduced in temperature and pressure by expansion to but little above ambient, to be expelled by the succeeding inward travel of the secondary pistons 4.

As the piston assembly units begin inward travel, under the force of the high pressure developed by combustion acting against the primary pistons 21, the compressor chambers B will be opened to the intake of ambient air, as described above.

As the piston assembly units approach full inward travel, the exhaust close cams 8 engage the actuators 10 and move the exhaust sleeves 3 outward, moving the sleeve ports 2 and housing ports 1 out of alignment, thus closing exhaust from the secondary chamber A.

Figure 1B:
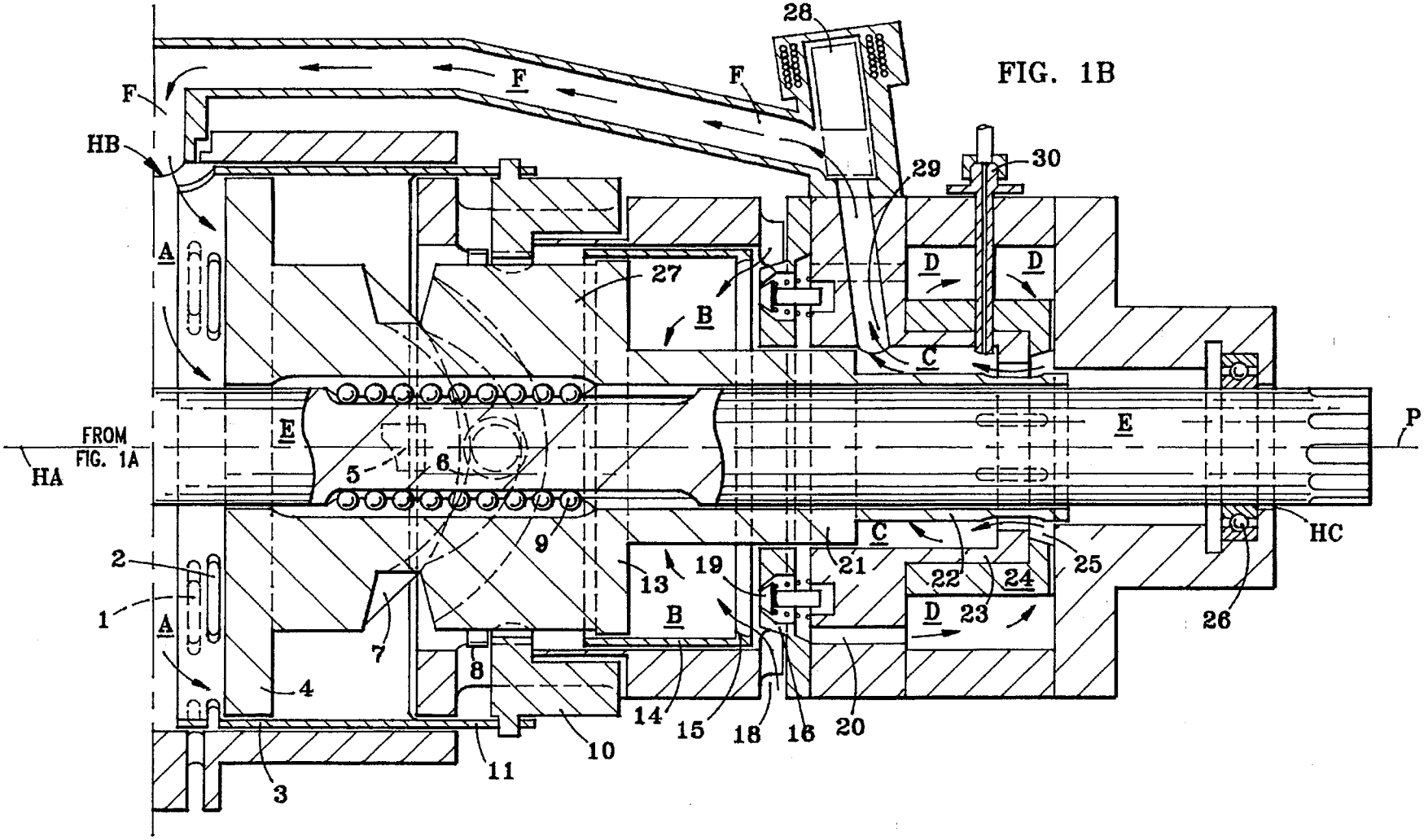
Figure 2A:
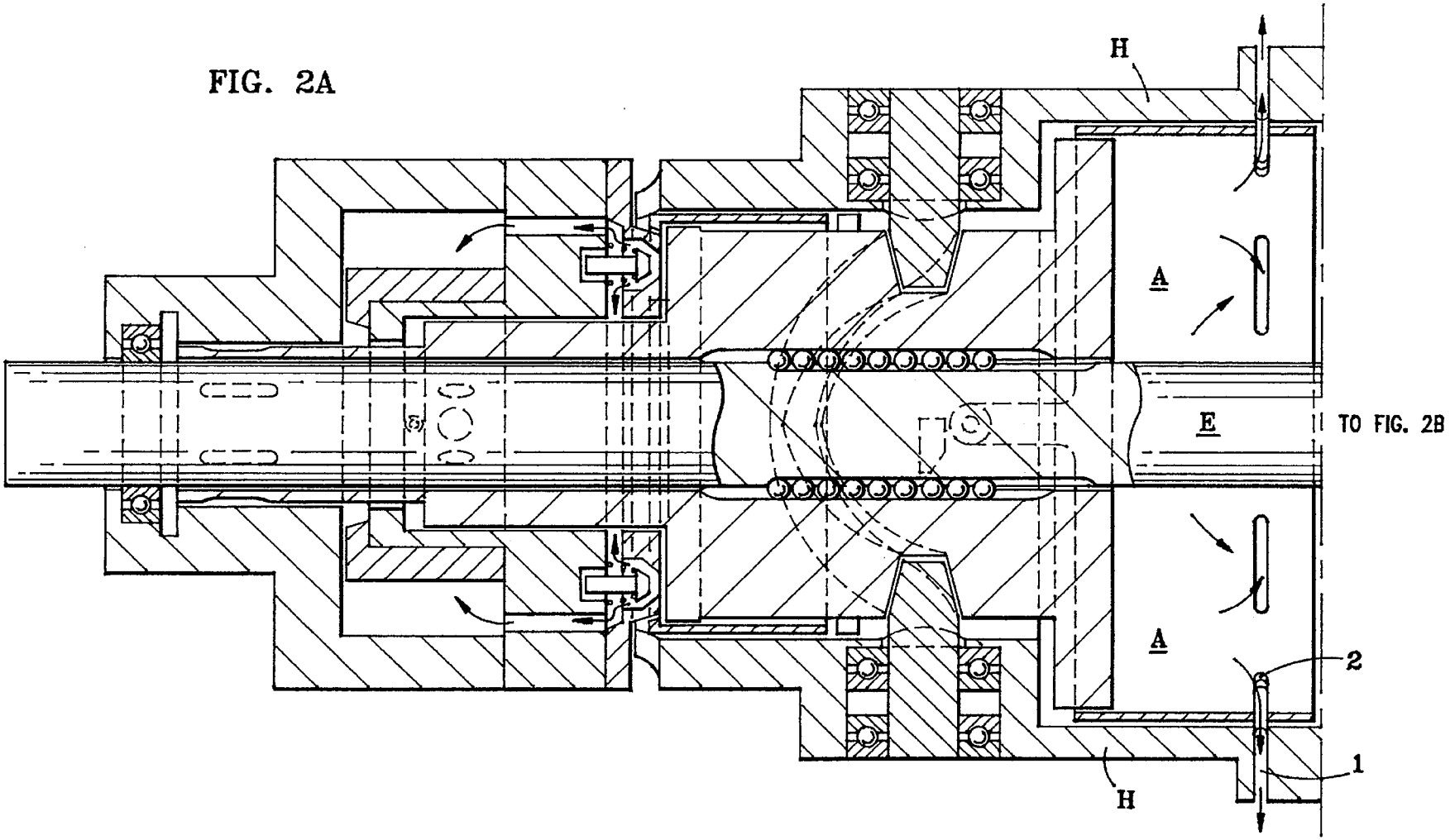
FIGS. 2A and 2B together are longitudinal schematic sectional views taken at right angles to FIGS. 1A and 1B.
Figure 2B:
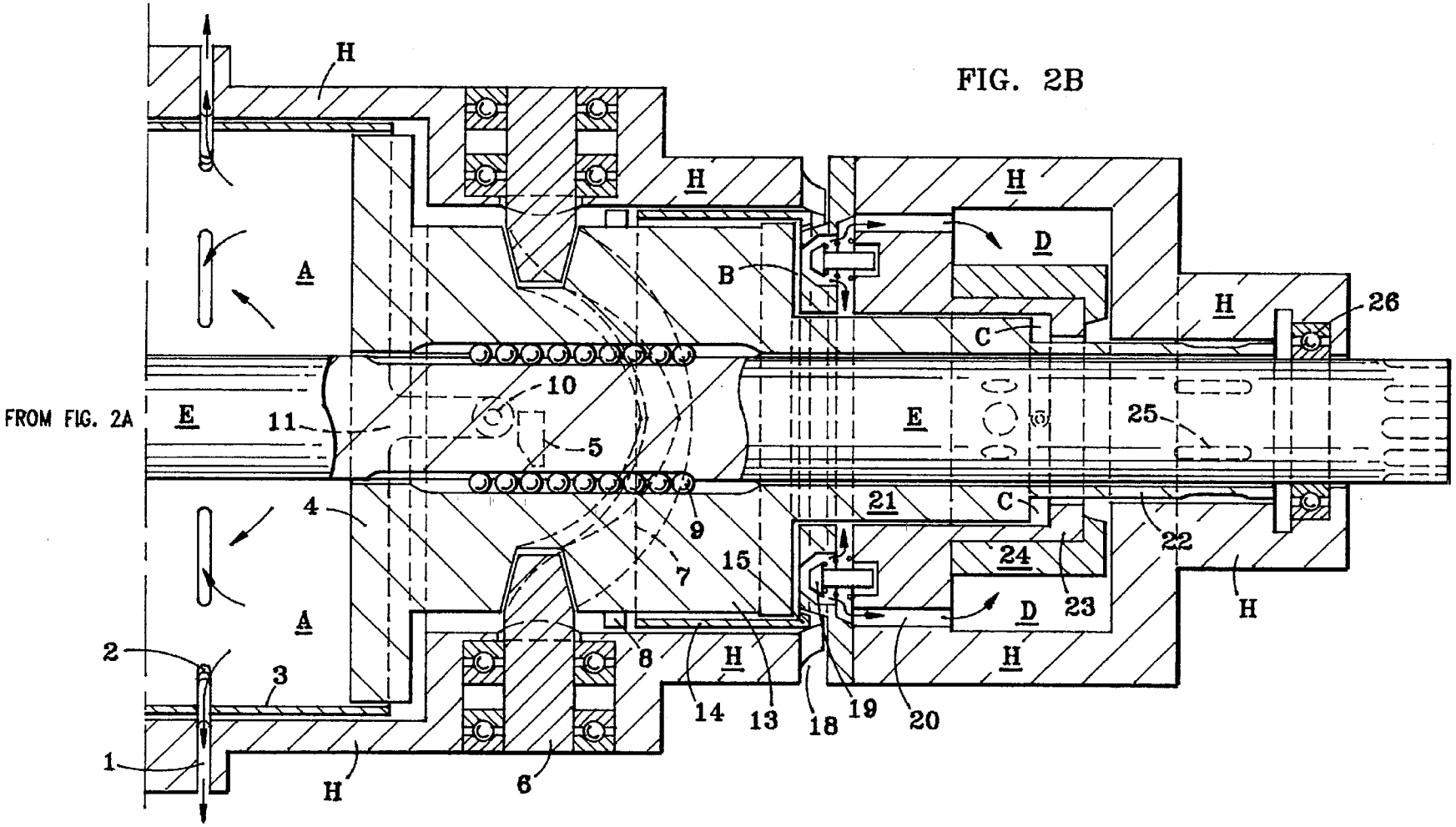

At the same time, the primary pistons 21 begin to uncover the transfer ports 29, allowing the expanding gases in the combustion chambers C to begin flowing out into the hollow transfer tubing F and from hollow transfer tubing F via a lateral hole HB in housing unit H into secondary chamber A. As this expansion lowers the pressure in the combustion chambers C, the last increment of inward travel by the piston assembly units moves the air inlet ports 25 to communicate between the combustion chambers C and plenum chambers D, as shown in FIG. 1, so the now superior pressure of the new air in the plenum chambers D will impel it into the combustion chambers C, scavenging the gases therein out through the transfer ports 29, and filling the combustion chambers C with new air to support the next combustion event.

The plenum chambers D are designed with sufficient volume so that, with the volume of input from the compressor chambers B and the pressure added by the heat from the combustion chambers C, superior pressure will remain in the plenum chambers D when the combustion chambers C are filled, so part of the new air will flow, as well, out through the transfer ports 29 until pressure in the secondary chamber A, the transfer tubes F, the combustion chambers C and the plenum chambers D is equalized.

With equal pressure thus acting against both ends of the piston assembly units, the greater areas of the secondary pistons 4 will develop the greater force, driving the piston assembly units outward.

As the piston assembly units begin outward travel, the compressor sleeves 14 will be moved to the closed position as described above, the air inlet ports 25 will be moved out of communication with the combustion chambers C and the primary pistons 21 will cover the transfer ports 29. The air in the compressor chambers B will be pumped into the plenum chambers D, the air in the combustion chambers C will be compressed and, as full outward travel is reached, the exhaust from the secondary chamber A will be opened, fuel will be injected into the combustion chambers C, combustion will occur and the cycle will reiterate.

To convert the longitudinal reciprocation of the piston assembly units into rotatory motion for the output shaft E, the rotator sections 27 are formed with the sinusoidal grooves 7, which encircle the rotator sections 27, and are shaped with two longitudinal excursions, which will produce four longitudinal strokes by the piston assembly unit for each revolution of the output shaft E.

The sinusoidal grooves 7 are engaged by two followers 6 for each of the piston assembly units. The followers 6 are located opposite each other, mounted in the housing unit H. They are mounted in bearings, free to rotate and thus roll along the face of the sinusoidal grooves 7. With the apogees of the sinusoidal grooves just past the followers 6 at full outward travel of the piston assembly units, pressure from combustion in the combustion chambers C acting against the primary pistons 21 will force the piston assembly units inward. The sinusoidal grooves 7 must track past the followers 6, causing the piston assembly units to rotate, both in the same direction, even though longitudinal travel is in opposite directions.

At full inward travel, the flywheel inertia of the rotating piston assembly units will carry the perigees of the sinusoidal grooves 7 past the followers 6 and the pressure of the gases now acting against the superior area of the secondary pistons 4 will force the piston assembly units outward and the return segments of the sinusoidal grooves 7 must track past the followers 6, continuing the rotation of the piston assembly units in the same direction, even though the direction of longitudinal travel has been reversed.

The piston assembly units are coupled to the output shaft E by the bearing splines 9, and the torque developed by the cam action of the sinusoidal grooves 7 will be transferred to the output shaft E over the arm represented by the distance of the center of the sinusoidal grooves 7 from the center of rotation of the piston assembly units/output shaft E.

The geometric relationship between the sinusoidal grooves 7 and the followers 6 produces a highly efficient camming action. The wall of the groove is at an acute angle to the longitudinal travel of the piston assembly units, thus contacts the round followers at a point offset from the followers' center of rotation, through which the longitudinal direction of the force acting on the piston assembly units is applied. The angular difference between the force line through the center of the followers and the point of their contact with the wall of the groove is additive to the cam angle established by the shape of the sinusoidal grooves 7, generating an effective cam angle more than twice as great as the angle provided by the shape of the groove. The force developed by the pressure of the gases acting against the pistons thus is converted to torque at an efficiency greater than 90% throughout 80% of the piston assembly units' rotation.

Auto-ignition (diesel ignition) is accomplished by compressing air in the combustion chambers C. During start-up of the engine, the initial air charge will be at ambient and the low compression ratio will not produce ignition temperature. The start-up valves 28 are held closed, as presented by the dotted line profile in FIGS. 1A and 1B, during start-up either electromagnetically as shown, or mechanically, closing the transfer ports 29. As the engine is cycled by a conventional starter (not shown) turning the output shaft E, the compressor pistons 13 will pump air into the plenum chambers D, from which it will flow into the combustion chambers C through the air inlet ports 25. With the transfer ports 29 closed by the start-up valves 28, the air cannot escape and continued cycling of the compressor pistons 13 will increase the pressure in the combustion chambers C until ignition temperature is reached by the further compression of the air confined in the combustion chambers C by the outward travel of the primary pistons 21. Injected fuel will then ignite, and its combustion will develop pressure great enough to overcome the closing force of the start-up valves 28, allowing flow into the transfer tubes F and secondary cylinder A, and normal operation to continue. De-energizing the start-up valves 28 will allow unrestricted flow.

What is claimed is:

1. An Internal Combustion Engine, comprising:

a. a housing unit made up of a first tubular section and a second tubular section identical to said first tubular section;

b. said first tubular section and said second tubular section being joined together and oriented opposite to one another with each said tubular section sharing a common horizontal tubular axis of symmetry;

c. said housing unit being walling for a plurality of cylindrical chambers;

d. said housing unit containing and holding a first piston assembly unit made up of a first primary piston conjoined with a first compressor piston and said first compressor piston conjoined with a first secondary piston and a second piston assembly unit configurationally and sizewise identical to said first piston assembly unit and made up of a second primary piston conjoined with a second compressor piston and said second compressor piston conjoined with a second secondary piston;

e. said first piston assembly unit being oriented opposite to said second piston assembly unit with each said piston assembly unit sharing a common horizontal piston axis of symmetry co-axial with said horizontal tubular axis of symmetry;

f. said first piston assembly unit being made of a plurality of round piston faces connected to one another by a plurality of first piston shanks and said second piston assembly unit being made of a plurality of round piston faces connected to one another by a plurality of second piston shanks numerically equal to said plurality of said first piston shanks;

g. a power output shaft passing longitudinally through and connected by way of a plurality of bearing splines to each said piston assembly unit with a horizontal shaft axis of symmetry being co-axial with said horizontal piston axis of symmetry and with said output shaft being mounted via shaft beatings at near a first end of said housing unit and similarly mounted at near a second end of said housing unit and extending outwardly through said housing unit via respectively a first through hole in said first end of said housing unit and a second through hole in said second end of said housing unit;

h. first sinusoidal groove means formed as a plurality of first excursions into a medialmost one of said first piston shanks being a first rotator section of said first piston assembly unit and second sinusoidal groove means identical to said first sinusoidal groove means and formed as a plurality of second excursions into a medialmost one of said second piston shanks being a rotator section of said second piston assembly unit;

i. a plurality of identical first rotatable cam follower means equal in number to the number of said first excursions and mounted in bearings to said housing unit engageable with said first sinusoidal groove means to facilitate rotatory motion in one direction of said first piston assembly unit;

j. a plurality of identical second rotatable cam follower means equal in number to the number of said second excursions and mounted in bearings to said housing unit engageable with said second sinusoidal groove means to facilitate rotatory motion of said second piston assembly unit in the same direction as said first piston assembly unit while said first piston assembly unit is moving longitudinally and said second piston assembly unit is moving longitudinally simultaneously in synchrony with but away from said first piston assembly unit;

k. said plurality of cylindrical chambers consisting of a first annular primary combustion chamber encased within a first primary cylinder located near said first end of said housing unit, a second annular primary combustion chamber encased within a second primary cylinder located near said second end of said housing unit, a first annular plenum chamber surrounding said first primary cylinder and located nearer said first end of said housing unit than said first annular primary combustion chamber and with a span greater than a span of said first primary cylinder, a second annular plenum chamber surrounding said second primary cylinder and located nearer said second end of said housing unit than said second annular primary combustion chamber and with a span greater than a span of said second primary cylinder, a first compressor chamber located medial to said first annular primary combustion chamber, a second compressor chamber located medial to said second annular primary combustion chamber, and, a secondary chamber located medial to said first compressor chamber, a head of said first secondary piston and medial to said second compressor chamber and a head of said second secondary piston;

l. a first fuel injector unit piercing said housing unit from exterior said housing unit and passing inwardly through said first plenum chamber into said first annular primary combustion chamber;

m. a second fuel injector unit piercing said housing unit from exterior said housing unit and passing inwardly through said second plenum chamber into said second annular primary combustion chamber;

n. a first start up valve affixed exteriorly to said housing unit medial to said first fuel injector and communicating through said housing unit with said first annular primary combustion chamber;

o. a second start up valve affixed exteriorly to said housing unit medial to said second fuel injector and communicating through said housing unit with said second annular primary combustion chamber;

p. air inlet connecting means as between said first annular primary combustion chamber and said first annular plenum chamber;

q. air inlet connecting means as between said second annular primary combustion chamber and said second annular plenum chamber;

r. a first transfer port located within walling of said first primary cylinder;

s. a second transfer port located within walling of said second primary cylinder;

t. hollow transfer robing connecting said first annular primary combustion chamber via said first transfer port and a first hole in said first start up valve to said secondary chamber via a lateral wall hole in said housing unit and further connecting said second annular primary combustion chamber via said second transfer port and a first hole in said second start up valve to said secondary chamber via said lateral wall hole in said housing unit;

u. a first pair of check valve means held within said housing unit as between said first annular plenum chamber and said first compressor chamber, each member of said first pair serving to control the flow of gas via an air passageway as between said first annular plenum chamber and said first compressor chamber;

v. a second pair of check valve means held within said housing unit as between said second annular plenum chamber and said second compressor chamber, each member of said second pair serving to control the flow of gas via an air passageway as between said second annular plenum chamber and said second compressor chamber;

w. a first moveable exhaust sleeve circumscribing inner walling of said secondary chamber;

x. a second moveable exhaust sleeve circumscribing inner walling of said secondary chamber said second moveable exhaust sleeve being identical in size and shape to said first moveable exhaust sleeve;

y. a first pair of housing port means positioned within said housing unit facilitating communication via a first pair of sleeve ports in said first exhaust sleeve as between air exterior to said housing unit and hot gas within said secondary chamber when said hot gas has operated to push said first piston assembly unit and said second piston assembly unit maximally away from one another, z. a second pair of housing port means positioned within said housing unit and opposite the location of said first pair of housing port means, said second pair of housing port means facilitating communication via a second pair of sleeve ports in said second exhaust sleeve as between air exterior to said housing unit and hot gas within said secondary chamber when said hot gas has operated to push said first piston assembly and said second piston assembly maximally away from one another;

aa. a first pair of sleeve tangs extending from said first exhaust sleeve directionally toward said first end of said housing unit;

bb. a second pair of sleeve tangs extending from said second exhaust sleeve directionally toward said second end of said housing unit;

cc. a first actuator unit mounted within said housing unit to a first member of said first pair of sleeve tangs;

dd. a second actuator unit mounted within said housing unit to a second member of said first pair of sleeve tangs opposite to said first actuator unit;

ee. a third actuator unit mounted within said housing unit to a first member of said second pair of sleeve tangs;

ff. a fourth actuator unit mounted within said housing unit to a second member of said second pair of sleeve tangs opposite to said third actuator unit gg. a first compressor sleeve mounted within said housing unit circumscribing said first compression chamber;

hh. a second compressor sleeve mounted within said housing unit circumscribing said second compression chamber;

ii. a plurality of piston ring sealing means positioned as between said compressor pistons and said compressor sleeves;

jj. a first tapered flange means attached to said first compressor sleeve, serving to permit air flow into said first compressor chamber;

kk. a second tapered flange means attached to said second compressor sleeve, serving to permit air flow into said second compressor chamber;

ll. a first flange seat disc being an outer head of said first compressor chamber;

mm. a second flange seat disc being an outer head of said second compressor chamber;

nn. a first sleeve extension affixed to and extending outwardly from said first primary piston and circumscribing said power output shaft and passing through an outer head of said first annular primary combustion chamber;

oo. a second sleeve extension affixed to and extending outwardly from said first primary piston and circumscribing said power output shaft and passing through an outer head of said second annular primary combustion chamber;

pp. a first pair of air inlet ports found within said first sleeve extension near said first end of said power output shaft;

qq. a second pair of air inlet ports found within said second sleeve extension near said second end of said power output shaft;

rr. a first pair of exhaust closing cam units, a first member of said first pair being adjoined to said rotator section of said first piston assembly unit and a second member of said first pair being adjoined to said rotator section of said first piston assembly unit directly opposite the location of said first member;

ss. a second pair of exhaust closing cam units, a first member of said second pair being adjoined to said rotator section of said second piston assembly unit and a second member of said second pair being adjoined to said rotator section of said second piston assembly unit directly opposite the location of said first member;

tt. a first fin exteriorly affixed to and formed about said first primary cylinder;

uu. a second fin exteriorly affixed to and formed about second primary cylinder;

vv. a first pair of exhaust open cam units, a first member of said first pair of said exhaust open cam units being adjoined to said rotator section of said first piston assembly unit and a second member of said first pair of exhaust open cam units being adjoined to said rotator section of said first piston assembly unit directly opposite the location of said first member of said first pair of exhaust open cam units with said first pair of exhaust open cam units being located affixed to said rotator section of said first piston assembly unit medial to the location of affixation of said first pair of exhaust closing cam units affixed to said rotator section of said first piston assembly unit; and ww. a second pair of exhaust open cam units, a first member of said second pair of said exhaust open cam units being adjoined to said rotator section of said section piston assembly unit and a second member of said second pair of exhaust open cam units being adjoined to said rotator section of said second piston assembly unit directly opposite the location of said second member of said second pair of exhaust open cam units with said pair of exhaust open cam units being located affixed to said rotator section of said second piston assembly unit medial to the location of affixation of said second pair of exhaust closing cam units affixed to said rotator section of said second piston assembly unit.

* * * * *